US006666608B1

(12) United States Patent
Chen

(10) Patent No.: US 6,666,608 B1
(45) Date of Patent: Dec. 23, 2003

(54) PAPER RETAINING STRUCTURE OF A LOOSE-LEAF FILE FOLDER

(76) Inventor: Chin-Liang Chen, No. 492, Chung Shan Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/361,174

(22) Filed: Feb. 10, 2003

(51) Int. Cl.[7] ..... B42F 3/00

(52) U.S. Cl. ..... 402/58; 24/67 R; 24/67.11; 281/15.1; 281/21.1; 402/60; 402/70; 402/73; 402/80 R; 402/502; D19/26

(58) Field of Search ..... 402/58, 59, 60, 402/62, 63, 64, 68, 70, 73, 80 R, 80 P, 500, 502; D19/26, 27; 281/15.1, 21.1, 27.1; 24/67 R, 67.1, 67.5, 67.11

(56) References Cited

U.S. PATENT DOCUMENTS 944,653 A * 12/1909 Bayles ..... 402/28
1,094,019 A * 4/1914 Reifel et al. ..... 402/28
2,376,423 A * 5/1945 Evans ..... 402/64
3,262,454 A * 7/1966 Shillinger ..... 402/70
4,340,316 A * 7/1982 Jahn ..... 402/68
5,405,209 A * 4/1995 Johns et al. ..... 402/28
5,690,443 A * 11/1997 Sullivan ..... 402/63
6,565,278 B2 * 5/2003 Paine et al. ..... 402/70

* cited by examiner

*Primary Examiner*—Monica S. Carter
(74) *Attorney, Agent, or Firm*—Harrison & Egbert

(57) ABSTRACT

A loose-leaf file folder includes two covers, a spine made integrally with the covers, and a plurality of paper-holding sets, each set being formed of a shaft, a paper-holding stem, and a crossbar. The shaft and the stem are integrally made with one of the two covers such that the shaft and the stem are uprightly projected from a margin of the one of the two covers. The shaft and the stem are provided in a top end with a retaining hole. The crossbar is provided at two longitudinal ends with a retaining arm and is detachably joined with the shaft and the stem such that the two retaining arms of the crossbar are retained respectively and removably in the retaining holes of the shaft and the stem.

4 Claims, 11 Drawing Sheets

PAPER RETAINING STRUCTURE OF A LOOSE-LEAF FILE FOLDER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a loose-leaf file folder, and more particularly to a paper-retaining structure of the loose-leaf file folder.

BACKGROUND OF THE INVENTION

The conventional loose-leaf file folder comprises two covers, a spine located between the two covers, and a paper-retaining structure enabling papers to be easily removed or replaced. The paper-retaining structure comprises two paper-holding devices opposite to each other. The paper-holding devices may comprise an elastic means to hold the papers in place. The paper-holding devices are mounted in the folder by a locating means.

The conventional loose-leaf file folder is defective in design in that the paper-retaining structure is complicated in construction and is therefore not cost-effective. In addition, the paper-retaining structure is made of a material different in nature from the material of which the covers and the spine of the conventional loose-leaf file folder are made. As a result, the conventional loose-leaf file folder cannot be integrally made. In light of the covers, the spine, and the paper-retaining structure of the conventional loose-leaf file folder being made of different materials, the conventional loose-leaf file folder poses an environmental problem on the grounds that the discarded file folder of the prior art cannot be economically recycled.

BRIEF SUMMARY OF THE INVENTION

The primary objective of the present invention is to provide a loose-leaf file folder which is free of the deficiencies of the prior art loose-leaf file folder described above.

In keeping with the principle of the present invention, the foregoing objective of the present invention is attained by a loose-leaf file folder comprising two covers, a spine located between the two covers and made integrally with the two covers, and a paper-retaining structure enabling papers, cards, etc. to be easily removed, replaced or put back in place. The paper-retaining structure comprises a plurality of paper-holding sets, each being formed of a shaft, a paper-holding stem, and a crossbar. The shaft and the stem are integrally made with the covers and are uprightly projected from a margin of one of the two covers. The shaft and the stem are provided in the top end with a retaining hole. The crossbar is provided at the two longitudinal ends with a retaining arm. The crossbar is removably joined with the shaft and the stem such that one retaining arm of the crossbar is removably retained in the retaining hole of the shaft, and that the other retaining arm of the crossbar is removably retained in the retaining hole of the stem.

The features and the advantages of the present invention will be more readily understood upon a thoughtful deliberation of the following detailed description of three preferred embodiments of the present invention with reference to the accompanying drawings.

DETAILED DESCRIPTION OF THE INVENTION

Figure 1:
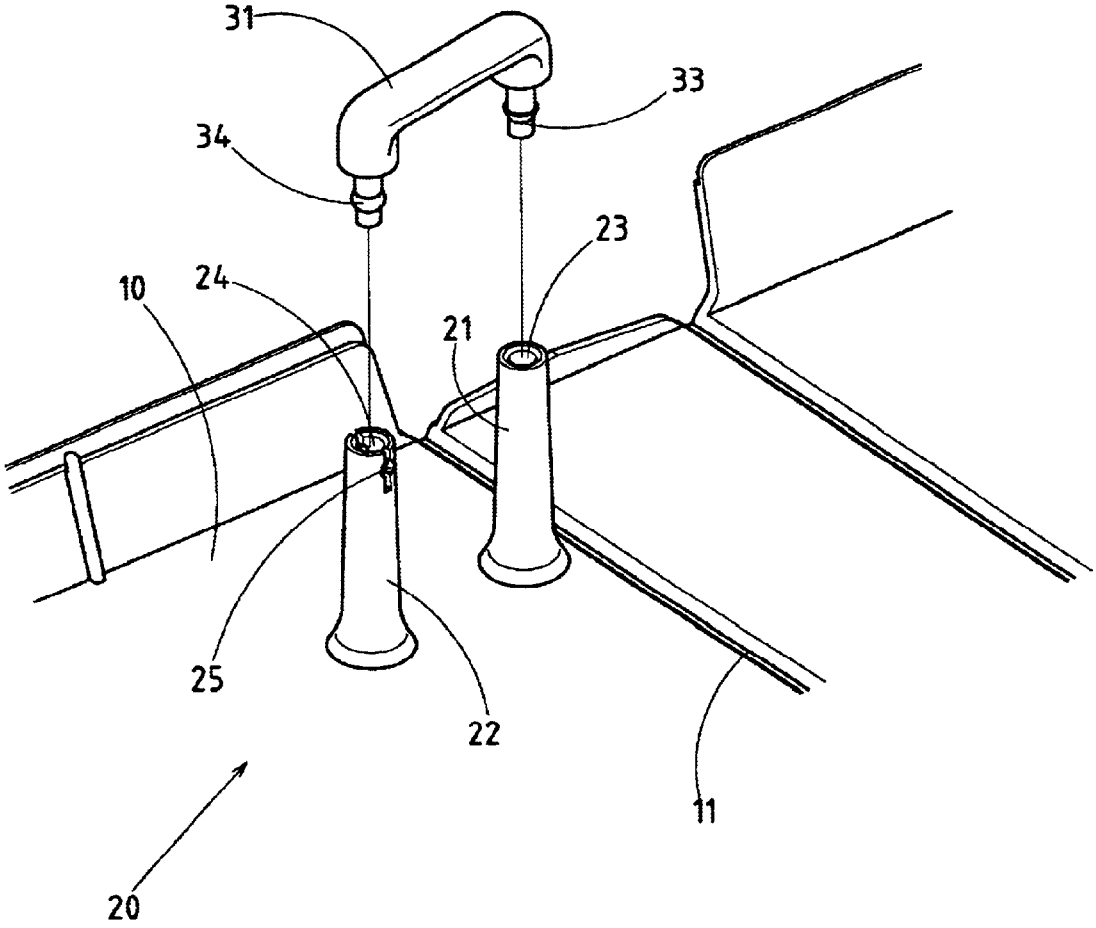
FIG. 1 shows an exploded perspective view of a paper-holding set of a first preferred embodiment of the present invention.
Figure 2:
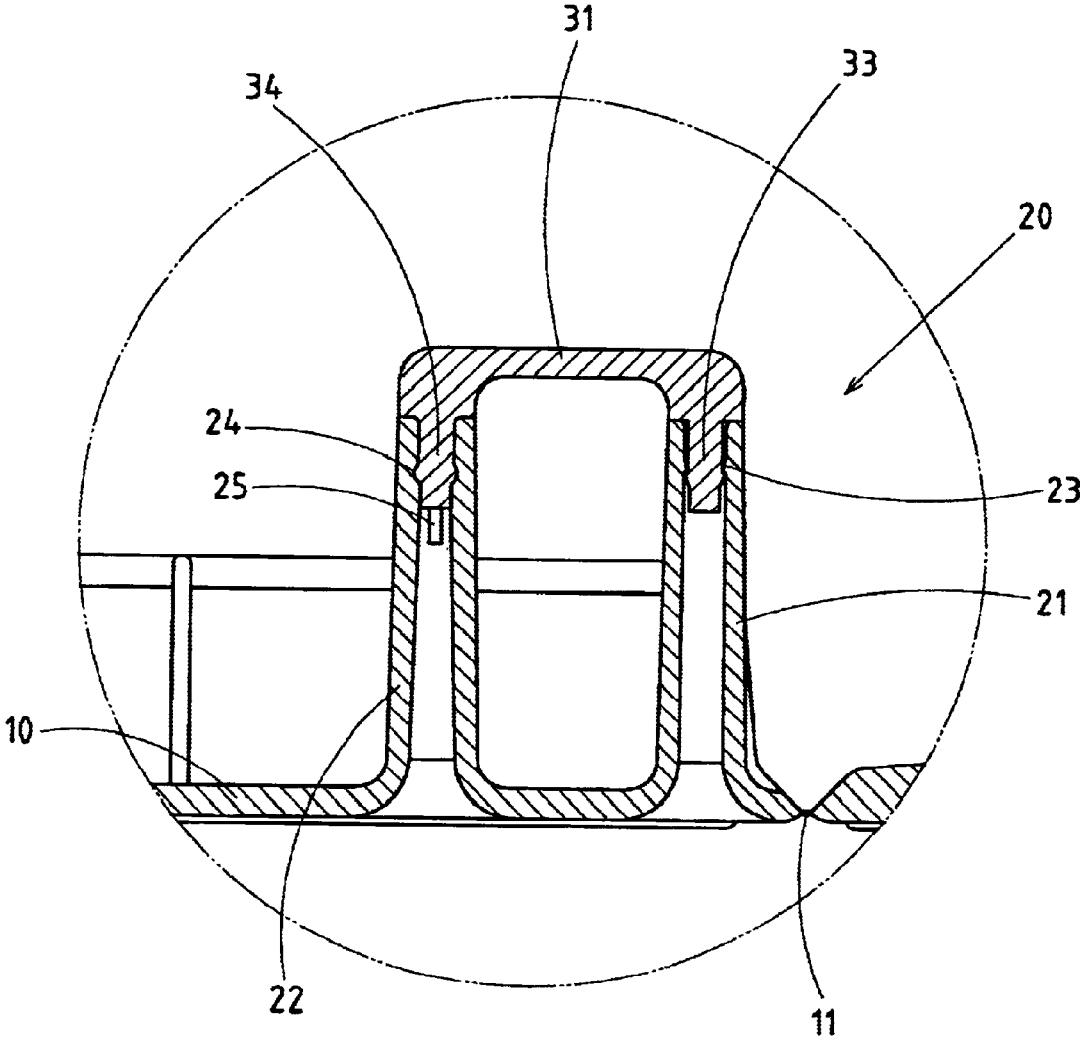
FIG. 2 shows a longitudinal sectional view of the paper-holding set of the first preferred embodiment of the present invention.
Figure 3:
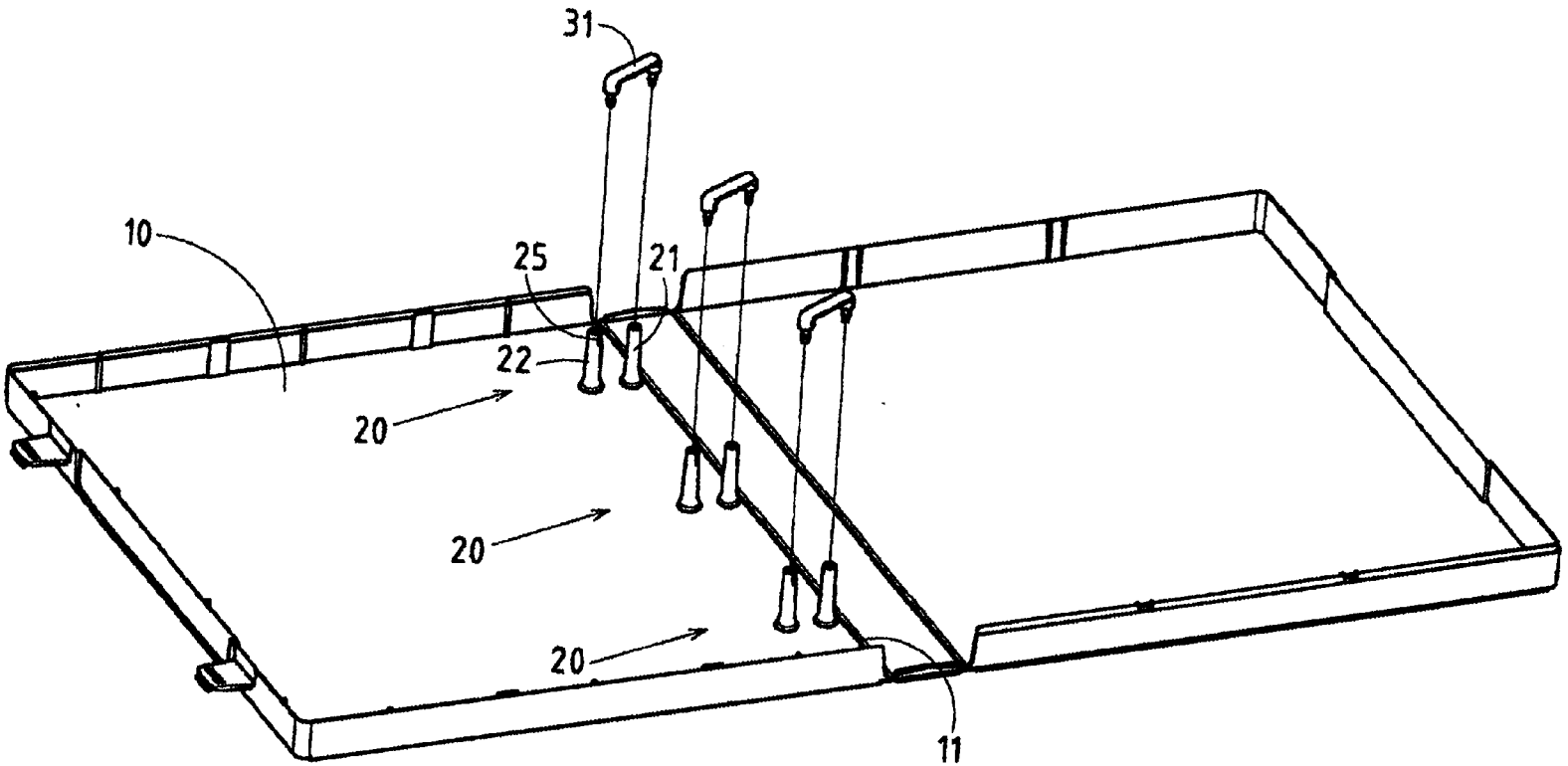
FIG. 3 shows a front spread-out view of the first preferred embodiment of the present invention.
Figure 4:
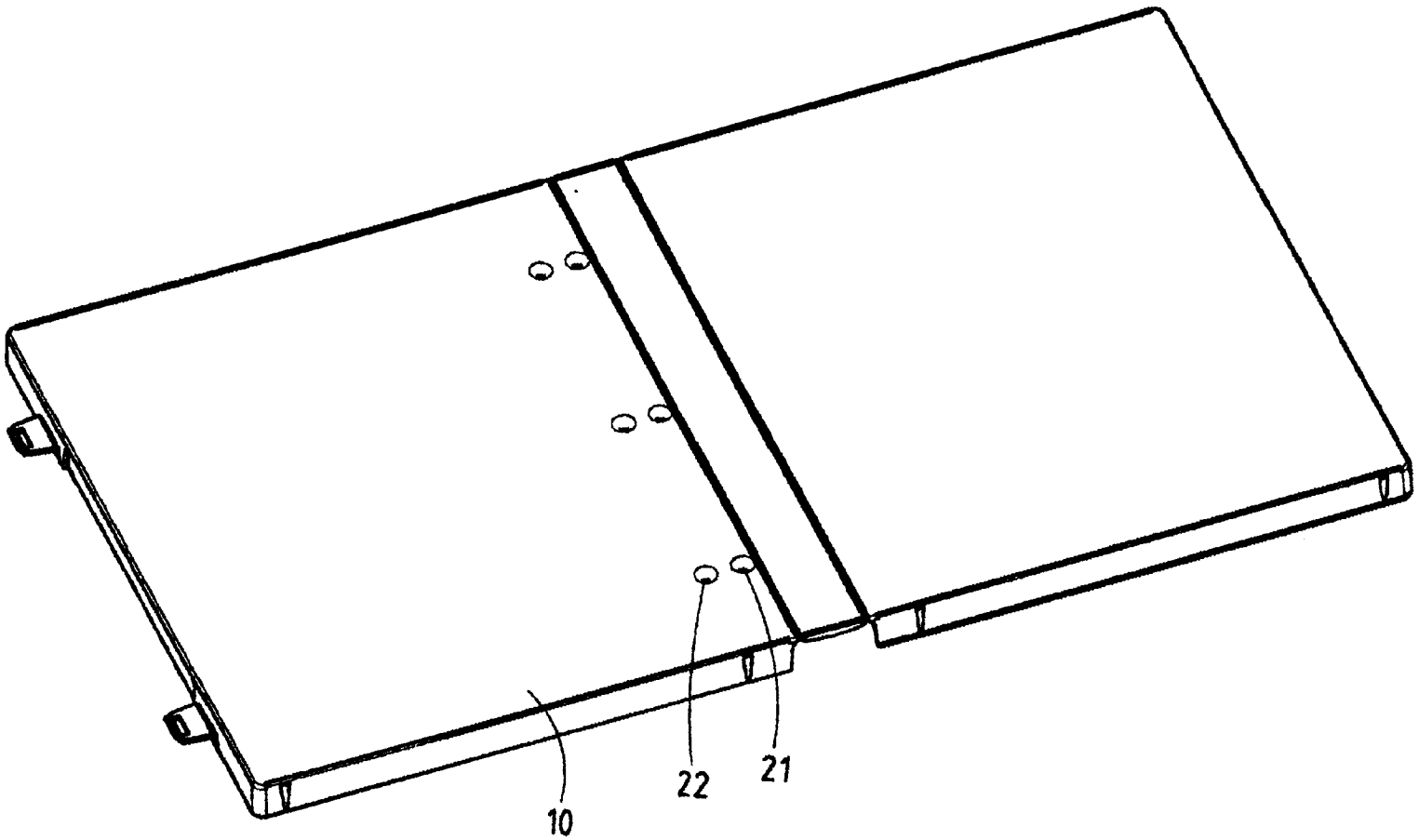
FIG. 4 shows a rear spread-out view of the first preferred embodiment of the present invention.
Figure 5:
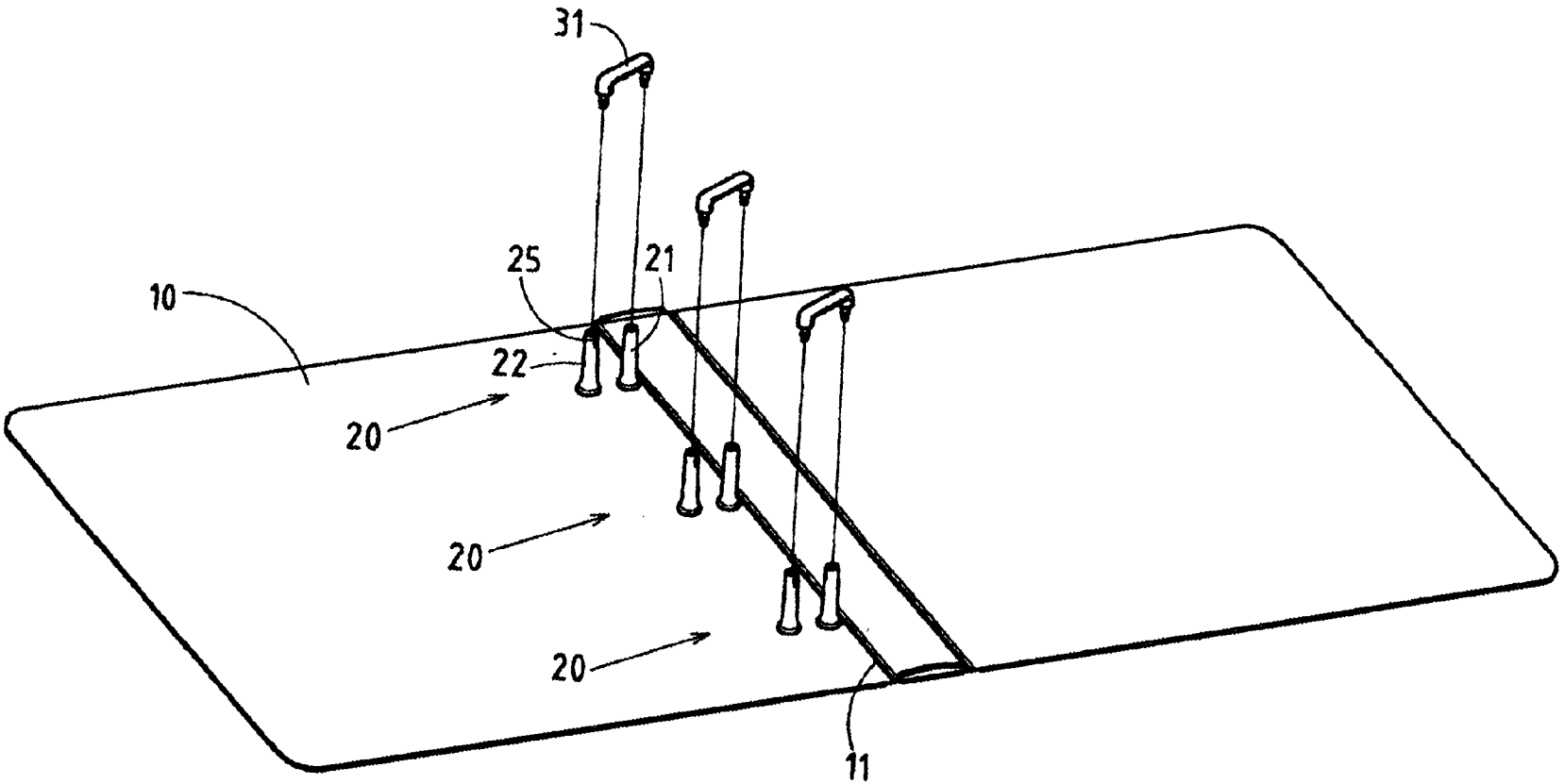
FIG. 5 shows another front spread-out view of the first preferred embodiment of the present invention.
Figure 6:
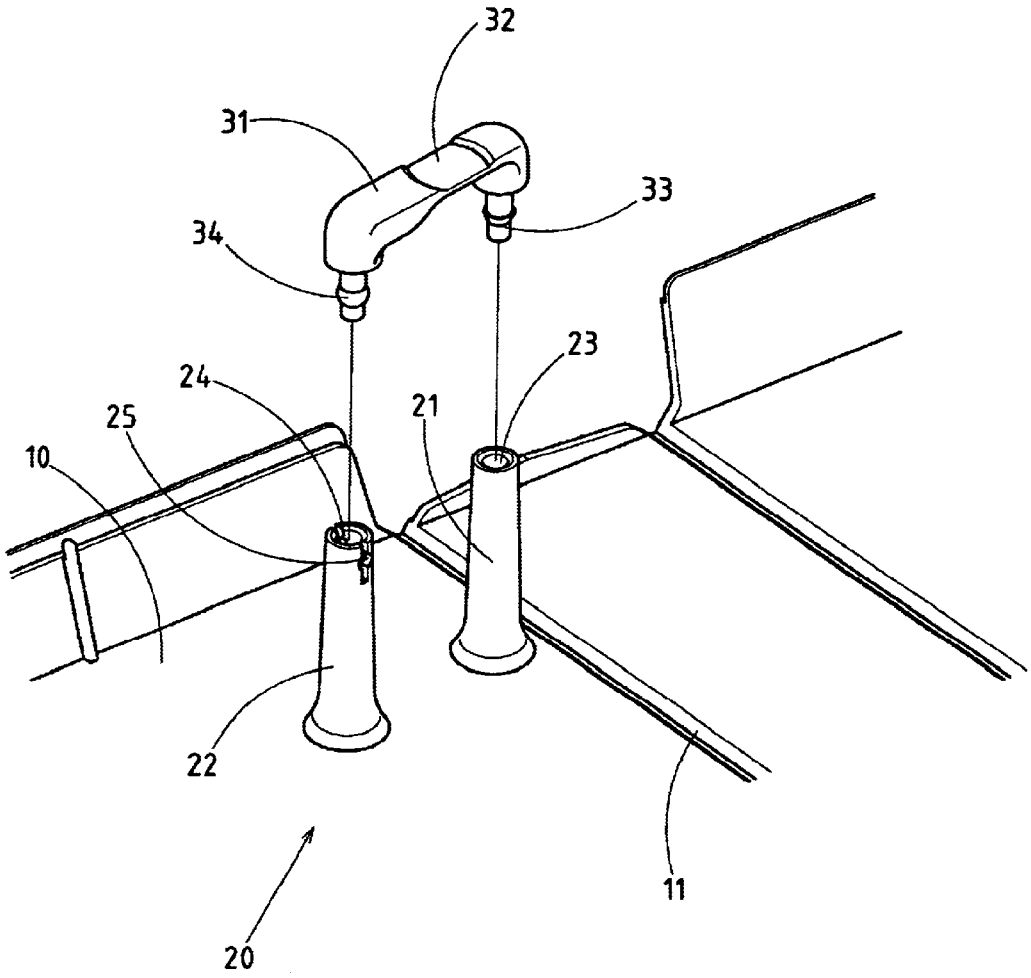
FIG. 6 shows an exploded perspective view of a paper-holding set of a second preferred embodiment of the present invention.
Figure 7:
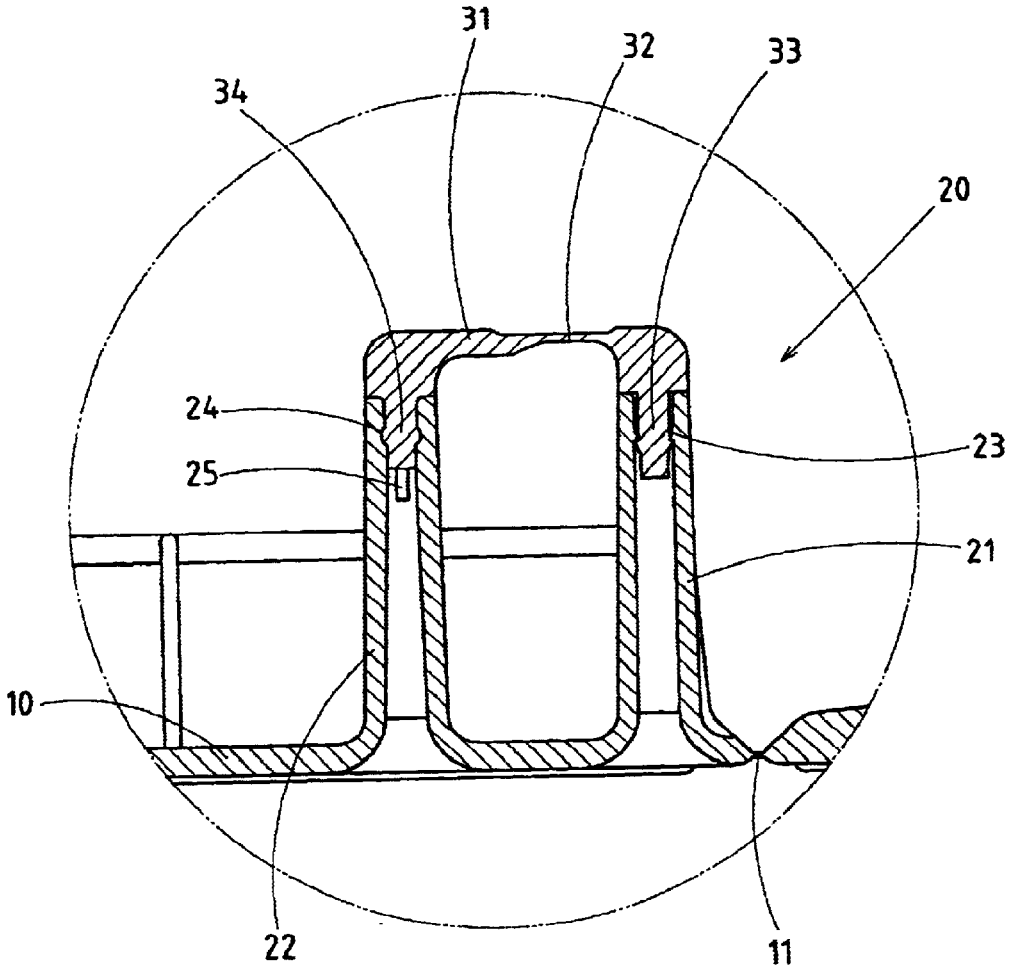
FIG. 7 shows a longitudinal sectional view of the paper-holding set of the second preferred embodiment of the present invention.
Figure 8:
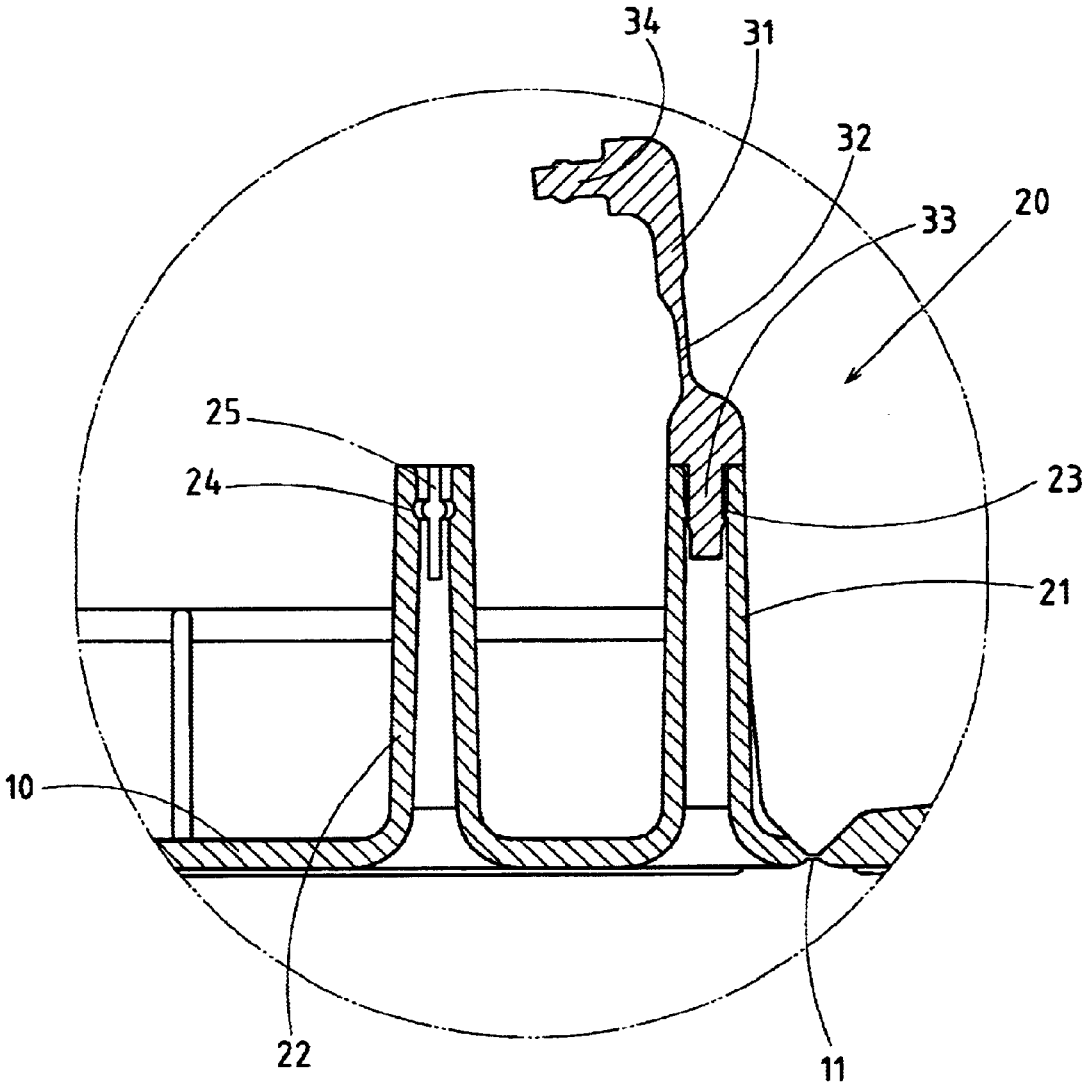
FIG. 8 shows a sectional schematic view of the paper-holding set of the second preferred embodiment of the present invention at work.

As shown in FIGS. 1–5, a loose-leaf file folder embodied in the present invention comprises two covers 10 opposite to each other, a spine 11 situated between the two covers 10, and a paper-retaining structure formed of a plurality of paper-holding sets 20 and located in proximity of a margin of one of the two covers 10, with the margin being contiguous to the spine 11.

The paper-holding sets 20 are identical in construction to one another and are formed of a shaft 21, a paper-holding stem 22, and a crossbar 31. The shaft 21 and the stem 22 are integrally made with the one of the two covers 10 and are uprightly projected from the margin of the one of the two covers. The shaft 21 and the stem 22 are opposite and parallel to each other. The shaft 21 is provided in the top end with a first retaining hole 23 while the stem 22 is provided in the top end with a second retaining hole 24. The crossbar 31 is provided at one longitudinal end with a first retaining arm 33, at the other longitudinal end with a second retaining arm 34. The crossbar 31 is detachably joined with the shaft 21 and the stem 22 in such a manner that the first retaining arm 33 of the crossbar 31 is removably retained in the first retaining hole 23 of the shaft 21, and that the second retaining arm 34 of the crossbar 31 is removably retained in the second retaining hole 24 of the stem 22. A filed paper can be easily removed by separating the crossbar 31 from the shaft 21 and the stem 22.

The second retaining hole 24 of the stem 22 is optionally provided in the wall with one or more slits 25 to facilitate the inserting and the removing of the second retaining arm 34 of the crossbar 31.

As shown in FIGS. 6–9, the crossbar 31 of the present invention is optionally provided with a pliable portion 32 enabling the first retaining arm 33 of the crossbar 31 to be retained in the first retaining hole 23 of the shaft 21 while the second retaining arm 34 of the crossbar 31 is separated from the second retaining hole 24 of the stem 22.

Figure 9:
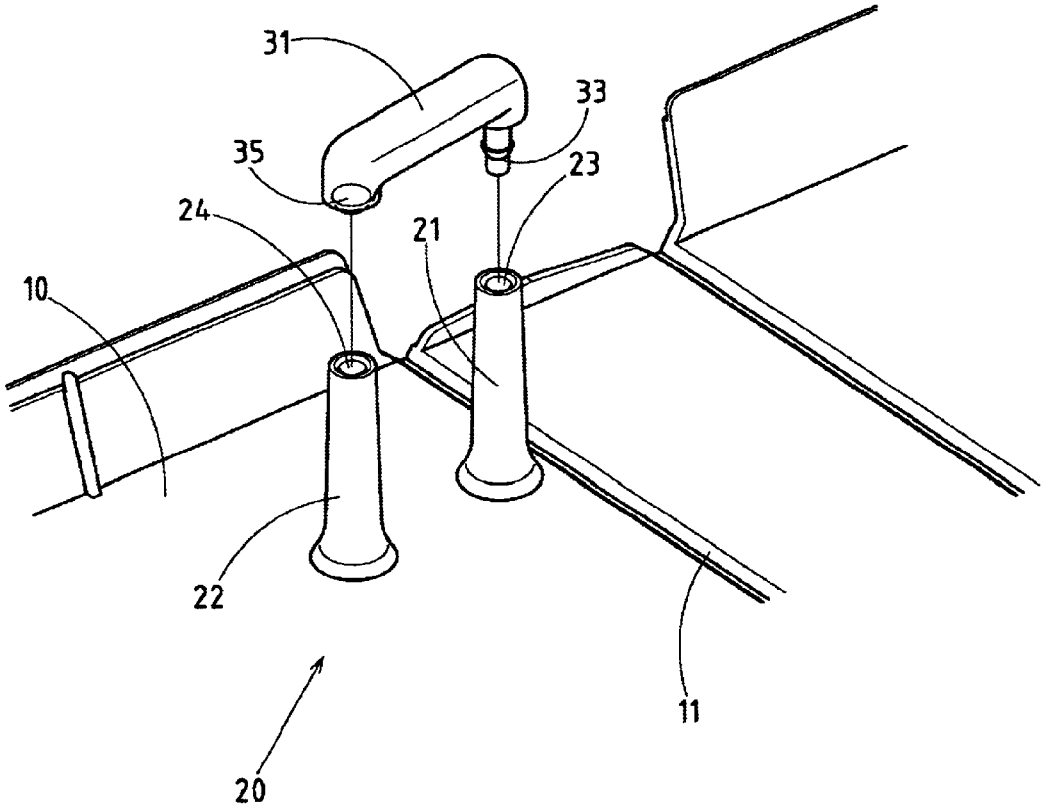
FIG. 9 shows an exploded perspective view of a paper-holding set of a third preferred embodiment of the present invention.
Figure 10:
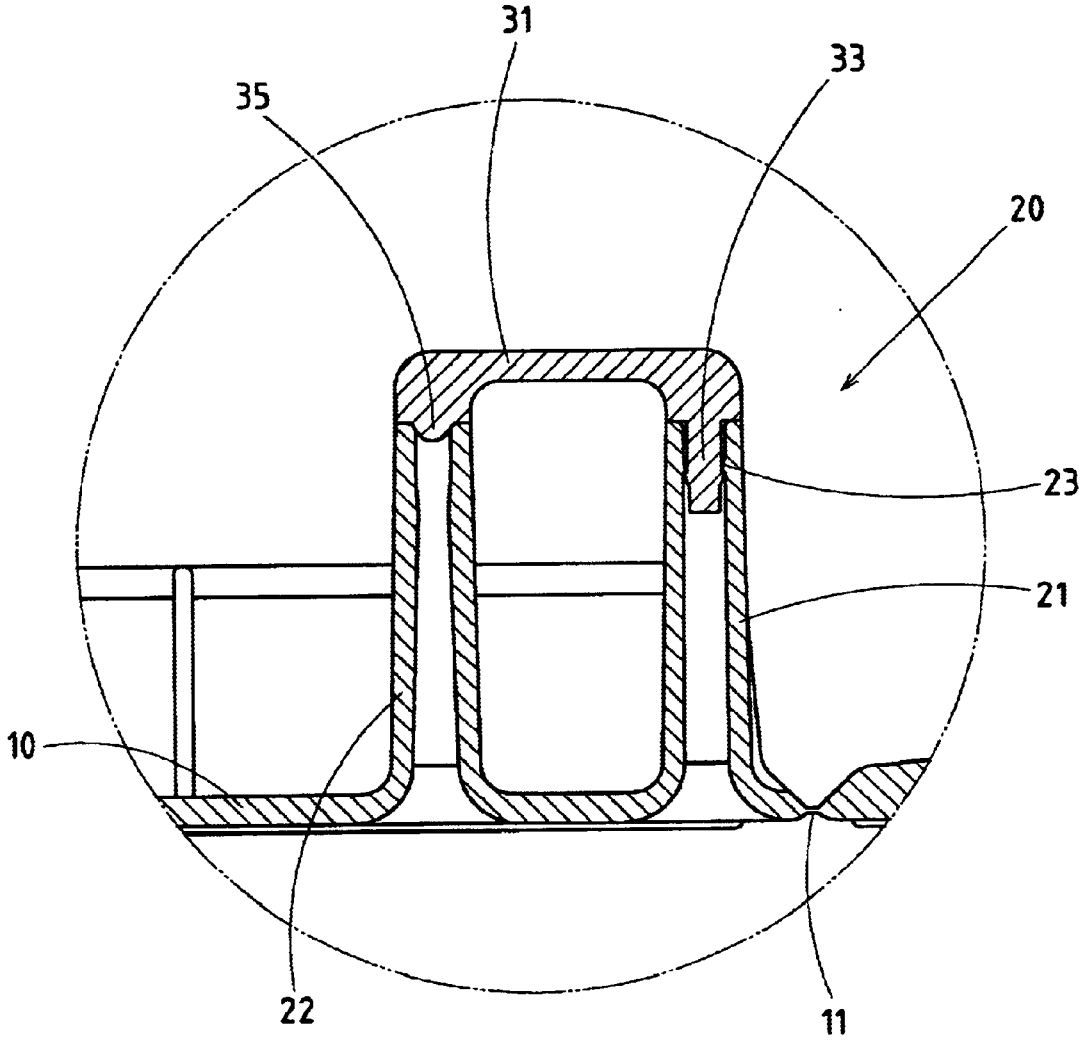
FIG. 10 shows a longitudinal sectional view of the paper-holding set of the third preferred embodiment of the present invention in combination.
Figure 11:
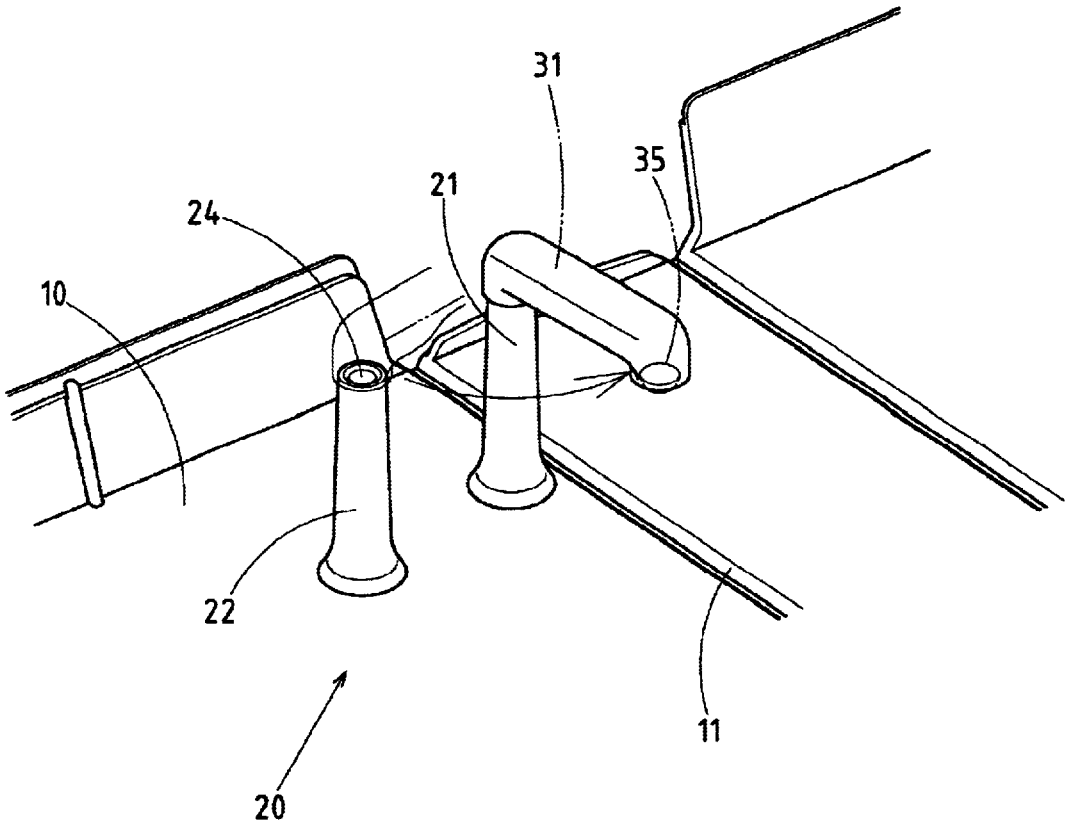
FIG. 11 shows a schematic view of the paper-holding set of the third preferred embodiment of the present invention at work.

As shown in FIGS. 9–11, the crossbar 31 of the present invention is provided with a retaining knob 35 in place of the second retaining arm 34. The retaining knob 35 is dimensioned to fit removably into the top end of the second retaining hole 24 of the paper-holding stem 22. When a filed paper is to be taken out of the folder, the crossbar 31 is turned on the first retaining arm 33, so as to cause the retaining knob 35 to move out of the top end of the second retaining hole 24 of the stem 22, as illustrated in FIG. 11.

The shaft 21 and the paper-holding stem 22 of the paper-holding sets 20 of the present invention are integrally made with the covers 10 and the spine 11. As a result, the loose-leaf file folder of the present invention is relatively cost-effective. In addition, the paper-holding sets 20 of the present invention are relatively more versatile.

The embodiments of the present invention described above are to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A loose-leaf file folder comprising:

two covers opposite to each other;

a spine made integrally with said two covers and situated between said two covers; and a paper-retaining structure located in proximity of a margin of one of said two covers, with the margin being contiguous to said spine;

wherein said paper-retaining structure comprises a plurality of paper-holding sets, each set being comprised of a shaft, a paper-holding stem, and a crossbar detachably joined with said shaft and said stem, said shaft being integrally made with the one of said two covers such that said shaft is uprightly projected from the margin of the cover, said paper-holding stem being integrally made with the one of said two covers such that said stem is uprightly projected from the margin of the cover, and such that said stem is opposite and parallel to said shaft, said crossbar being provided at one longitudinal end with a first retaining arm, and at another longitudinal end with a second retaining arm whereby said crossbar is detachably joined with said shaft and said stem in such a manner that said first retaining arm of said crossbar is retained removably and rotatably in a first retaining hole of a top end of said shaft, and such that said second retaining arm of said crossbar is removably retained in a second retaining hole of a top end of said paper-holding stem.

2. The loose-leaf file folder as defined in claim 1, wherein said second retaining hole of the top end of said paper-holding stem is comprised of one or more slits.

3. The loose-leaf file folder as defined in claim 1, wherein said crossbar is comprised of a pliable portion to enable said first retaining arm of said crossbar to be retained in said first retaining hole of the top end of said shaft at the time when said second retaining arm of said crossbar is separated from said second retaining hole of the top end of said paper-holding stem.

4. The loose-leaf file folder as defined in claim 1, wherein said crossbar is comprised of a retaining knob in place of said second retaining arm whereby said retaining knob is dimensioned to fit removably into said second retaining hole of said paper-holding stem.

* * * * *